US008102230B2

(12) United States Patent
Eriksen

(10) Patent No.: US 8,102,230 B2
(45) Date of Patent: Jan. 24, 2012

(54) INDUCTIVE COUPLER CONNECTOR

(75) Inventor: Asbjøm Eriksen, Skallestad (NO)

(73) Assignee: Eriksen Electric Power Systems AS, Skallestad (NO)

( * ) Notice: Subject to any disclaimer, the term of this patent is extended or adjusted under 35 U.S.C. 154(b) by 6 days.

(21) Appl. No.: 12/682,136

(22) PCT Filed: Oct. 10, 2008

(86) PCT No.: PCT/NO2008/000361

§ 371 (c)(1),
(2), (4) Date: Jul. 13, 2010

(87) PCT Pub. No.: WO2009/048339

PCT Pub. Date: Apr. 16, 2009

(65) Prior Publication Data

US 2011/0127842 A1 Jun. 2, 2011

(30) Foreign Application Priority Data

Oct. 12, 2007 (NO) ..... 20075260

(51) Int. Cl.
*H01F 17/06* (2006.01)

(52) U.S. Cl. ..... 336/178

(58) Field of Classification Search ..... 336/65, 336/83, 178, 210, 212; 439/194, 577
See application file for complete search history.

(56) References Cited

U.S. PATENT DOCUMENTS

| | | | | |
|---|---|---|---|---|
| 1,251,651 | A * | 1/1918 | Espenschied | 336/178 |
| 3,195,086 | A * | 7/1965 | Taylor | 336/83 |
| 4,048,602 | A | 9/1977 | Diamantides | |
| 4,199,744 | A * | 4/1980 | Aldridge et al. | 336/178 |
| 4,612,527 | A | 9/1986 | Third et al. | |
| 5,052,941 | A * | 10/1991 | Hernandez-Marti et al. | 439/194 |
| 5,719,546 | A | 2/1998 | Ito et al. | |
| 2004/0218406 | A1 | 11/2004 | Jang et al. | |
| 2006/0219208 | A1 | 10/2006 | Oh et al. | |
| 2006/0219308 | A1 | 10/2006 | Oh et al. | |

FOREIGN PATENT DOCUMENTS

| | | |
|---|---|---|
| DE | 43 44 071 A1 | 7/1995 |
| GB | 2 167 615 A | 5/1986 |
| JP | 63151006 (A) | 6/1988 |
| WO | WO 02/091399 A1 | 11/2002 |

OTHER PUBLICATIONS

International Search Report from the European Patent Office in International Application No. PCT/NO2008/00361, mailed Jan. 29, 2009.

* cited by examiner

*Primary Examiner* — Tuyen Nguyen
(74) *Attorney, Agent, or Firm* — Finnegan, Henderson, Farabow, Garrett & Dunner, L.L.P.

(57) ABSTRACT

An inductive coupler connector arrangement for transferring electrical energy between a first connector part to a second connector part. The first and second connector parts have respective ones of first and second magnetic core limbs of which at least one limb carrying a respective electrical winding and respective mating means adapted to provide at mating of said first and second connector parts a juxtaposition of abutting faces of respective ends of said respective ones of first and second magnetic core limbs. A gap between the coupler halves is filled with ferrofluid in the form of a deformable pad or tablet or a fat, grease or paste containing magnetic particles, in order to improve the magnetic coupling between said ends of said first and second magnetic core limbs.

19 Claims, 6 Drawing Sheets

INDUCTIVE COUPLER CONNECTOR

CROSS REFERENCE TO RELATED APPLICATION

This application is a 371 of PCT/NO2008/000361 filed Oct. 10, 2008.

The invention concerns a method and an arrangement for providing a means for reliable connection and disconnection of equipment pertaining to electric power systems and control systems, that does not involve a galvanic contact. The invention is particularly suitable for sub-sea located connectors for sub-sea electric power systems and control systems.

Sub-sea located electric power systems and control systems will require sub-sea mateable connection and disconnection systems for power and signals in order to both connect equipment during installation and to disconnect, and later reconnect equipment which must be brought to the surface for maintenance, repair or replacement.

Existing systems of today for purposes as those identified above are mainly conductive couplers (e.g. socket outlets) having systems included to avoid water intrusion to the electric contact pins during connection and later during operation, in order to avoid failure and loss of operation, typically due to earth fault or short circuit effected by moisture in the connector.

Conductive couplers of the type referred to above exhibit, however, still relatively high failure rates, mainly due to water intrusion which result in low reliability or availability for the overall systems in which existing such connectors have been employed.

To reduce or even avoid these problems, inductive couplers where the coupling elements are insulated from the surrounding elements have been developed. An inductive coupler is, in principle, a transformer where the iron core is made from two core halves, an having an insulated winding on each core half, see FIG. 1.

Figure 1:
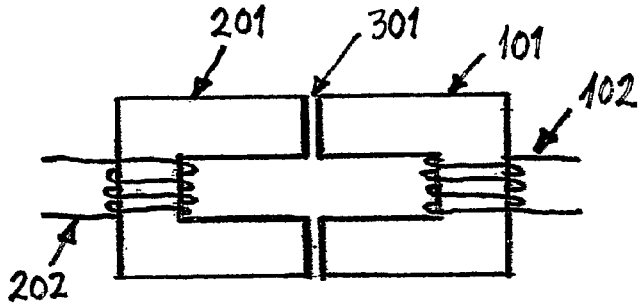
Figure 2:
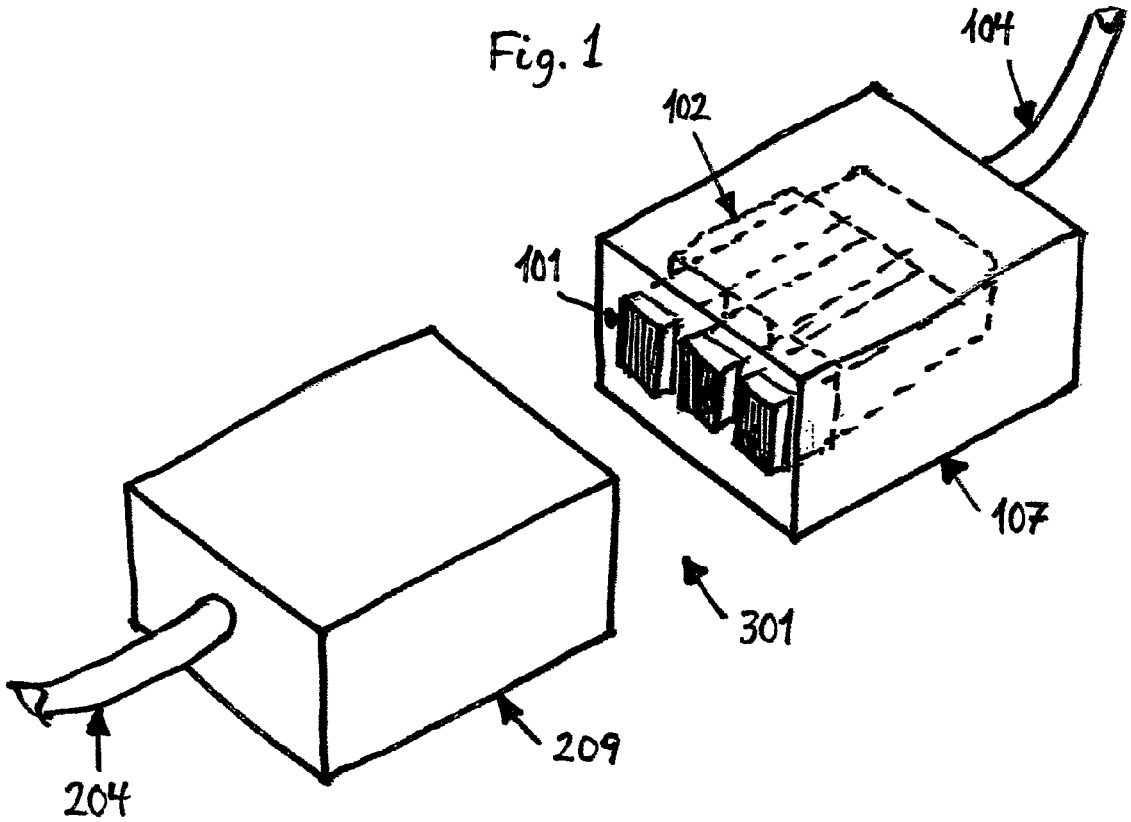

Reference is made to FIG. 1, illustrating a single phase inductive coupler, however, such inductive couplers can also be designed as multiple phase couplers, such as e.g. 3-phase couplers, as schematically illustrated in FIG. 2.

One problem with inductive couplers in use to now, is that it has been difficult to realize practical inductive connectors with a small gap, 301, when the two halves of the magnetic coupler connector are mated, which would result in less than desirable signal coupling, and also lower than desired electric efficiency.

Although several patent applications have been filed earlier for sub-sea inductive couplers earlier, a large number of these applications have been abandoned due to the problems experienced with insufficient signal coupling and insufficient electric efficiency.

Solutions suggested for improving the coupling in the air gap for inductive couplers include the use of higher frequencies for the transmission, such as for example disclosed in the patent application US 2004/0218406 A1.

In many cases where power transmission is required, use of higher frequencies could imply that frequency converters must be included in both halves of the coupler connector, where the frequency of the electrical power entering the connector is increased in one half coupler, and then reduced to the normal frequency in the other half. This additional equipment does, however, typically reduce the reliability of the overall connector arrangement, and will also lead to increased cost and complexity. Use of a higher frequency for the transmission of electrical power through the connector does, however, have the advantage that the weight and volume of the magnetic coupler connector may be reduced.

A further solution suggested for improving the magnetic coupling, has been to fill the unavoidable gap between the magnetic parts of the inductive coupler with what is typically referred to as a "ferrofluid". The ferrofluid is constituted by small magnetic particles suspended in a fluid. The fluid typically is a liquid, such as e.g. oil or water. The use of a ferrofluid in order to improve the magnetic coupling in inductive couplers has been proposed in published patents and patent applications: U.S. Pat. No. 4,048,602, GB A 2 167 615 and DE A1 43 44 071, to mention a few.

A problem remaining to be solved relating to the use of a fluid based ferrofluid for filling the air between the magnetic halves of the coupler is keeping the ferrofluid in place where it shall be of use. In particular, when the inductive coupler is not magnetized by electric energy that is being transferred through the magnetic coupler, no magnetic field is in place to keep the ferrofluid from flowing away from the gap area, which, when the coupler later is energized would lead to a reduction of the effective output, and, potentially, the excessive ferrofluid could create a "short circuit" in the magnetic field between the core limbs, so called leakage flux.

Another problem foreseen with ferrofluid for use in the magnetic coupler application is to provide a ferrofluid having the best, desirable magnetic properties, while still exhibiting excellent long term stability. The long term stability is known to be related to ability to the chemical stability of the magnetic particles, such as e.g. whether the particles of the ferrofluid can withstand corrosion.

Present commercially available types of ferrofluids are often based on magnetite particles, coated with a surfactant and suspended in water, oil or ester, and exhibiting a magnetic saturation of 20 to 40 milliTesla. When compared to the magnetic saturation level iron material of the magnetic couplers, that may be as high as 2000 milliTesla, clearly, the magnetic saturation level of the presently available ferrofluids is very small.

Long term stable particles with much better magnetic properties e.g. ferromagnetic ceramic particles or magnetic particles based on nano-technology have already been developed, and are currently being developed further, for use in space technology or for applications in medicine, such as e.g. in contrast fluids for magnetic resonance scanners. Ferrofluid based on such sophisticated magnetic particles exhibit much higher magnetic saturation level than the magnetite based fluids referred to above.

Ferrofluid in the form of a fluid having wax like properties is known from the published patent application: US A1 2006/0219308, where it is proposed used for a valve by heating the ferrofluid wax and then controlling it by a magnetic field.

The Japanese patent publication no. JP 63-151006 A describes an inductive coupler where the gap between coupler halves is filled with a magnetic substance to close the magnetic path.

The present inventions concerns a method and an arrangement for easy application of the relevant ferrofluid in the gap between the magnetic parts of the magnetic coupler, and for maintaining the ferrofluid in the gap, independently of the position or attitude assumed by the coupler.

Advantageously, the present invention provides a device for filling of the gap in the inductive coupler with a ferrofluid exhibiting very high viscosity or at least being in the form of a paste, such as fat, a plastic wax, or a putty, or similar means.

Figure 3A:
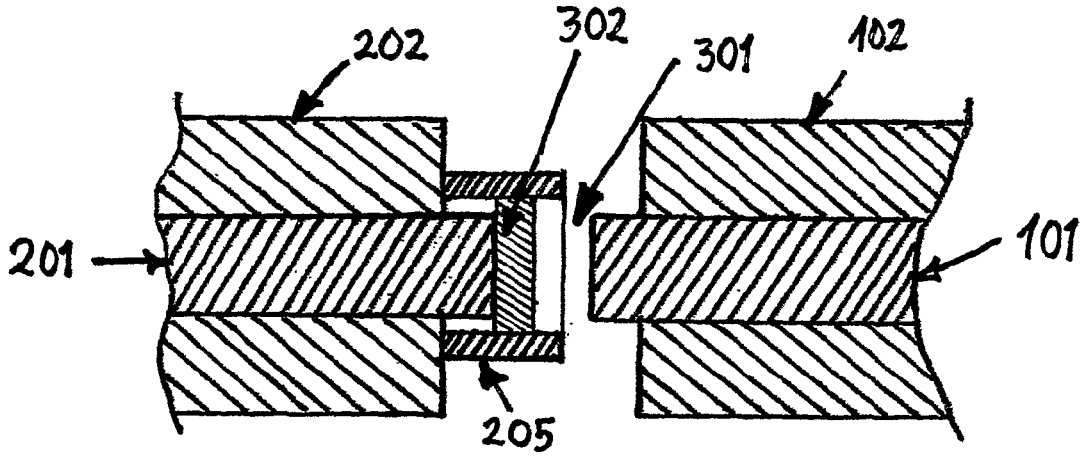
Figure 3B:
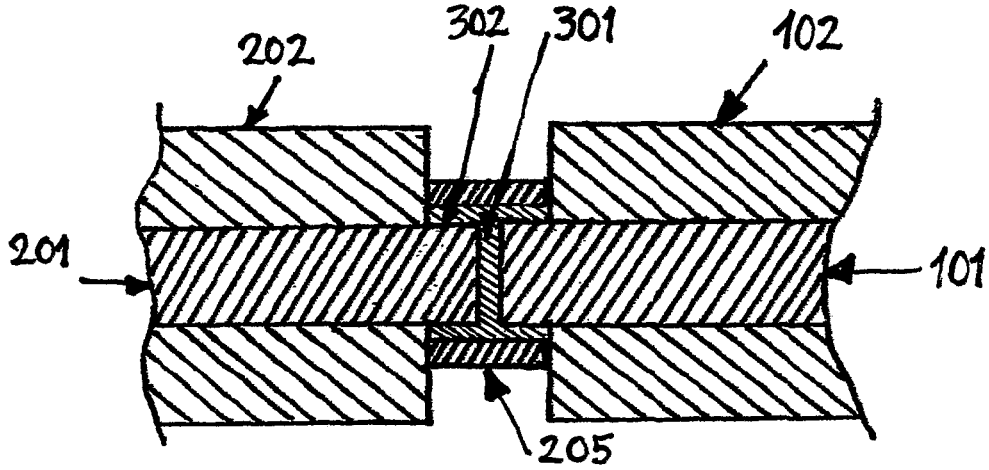
Figure 4A:
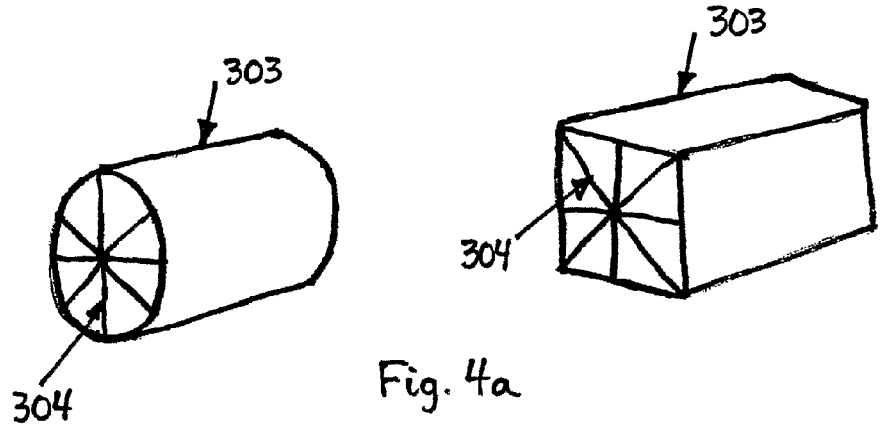
Figure 4B:
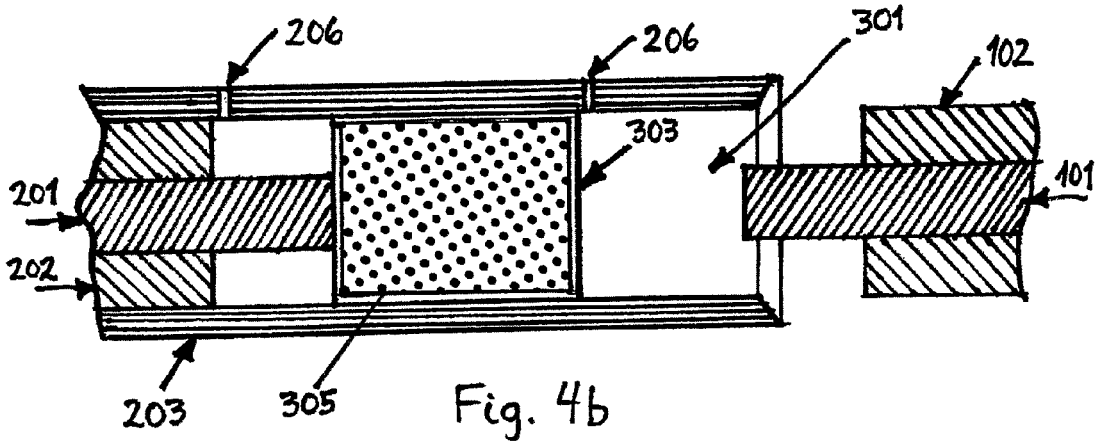
Figure 4C:
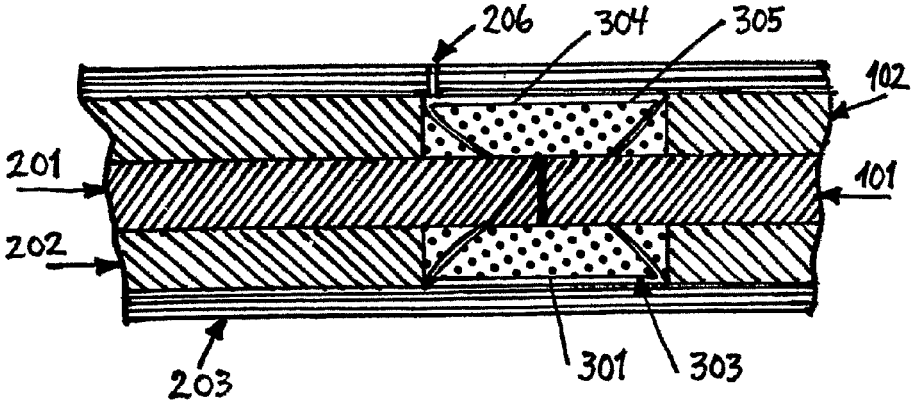
Figure 5A:
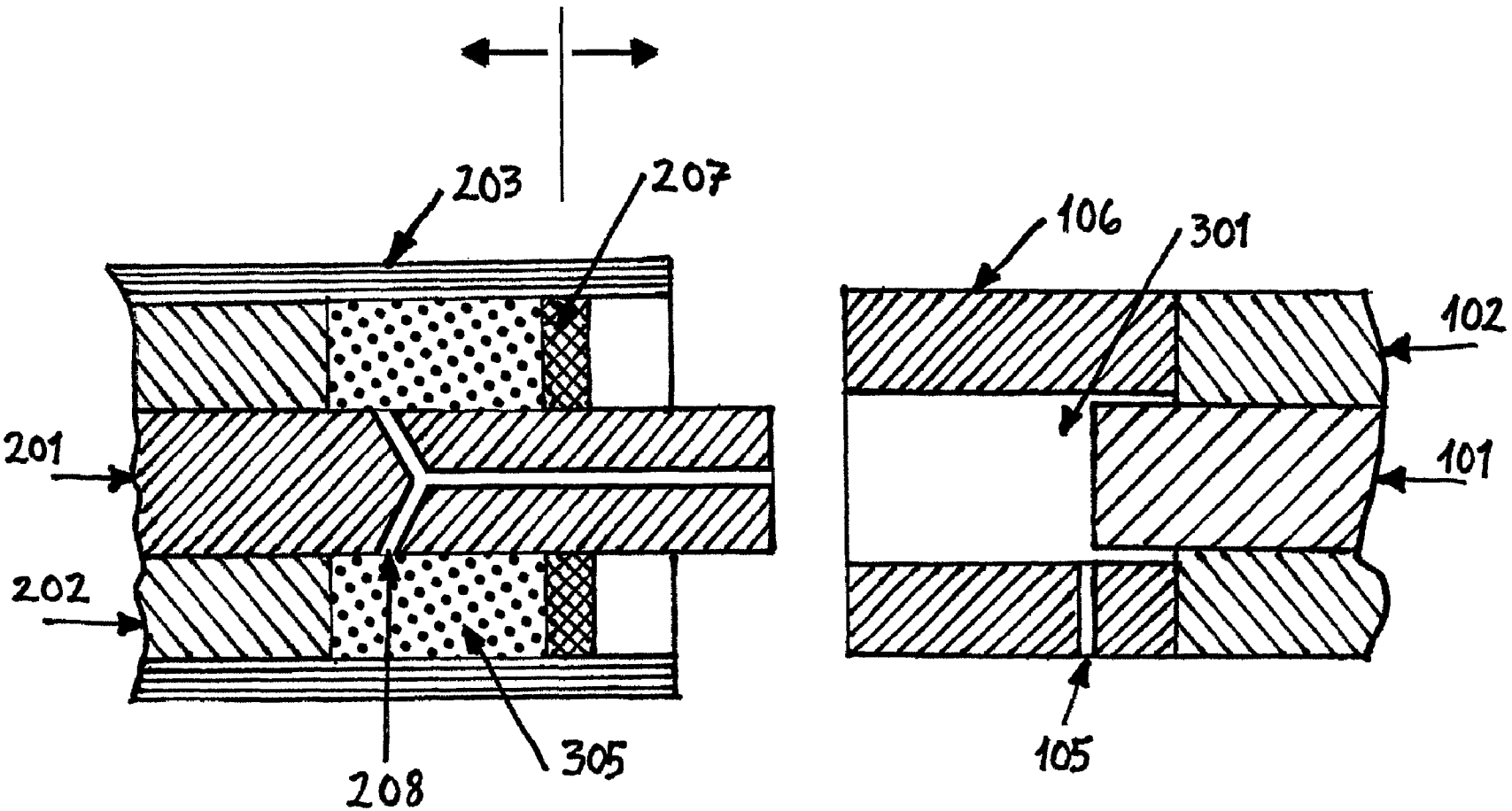
Figure 5B:
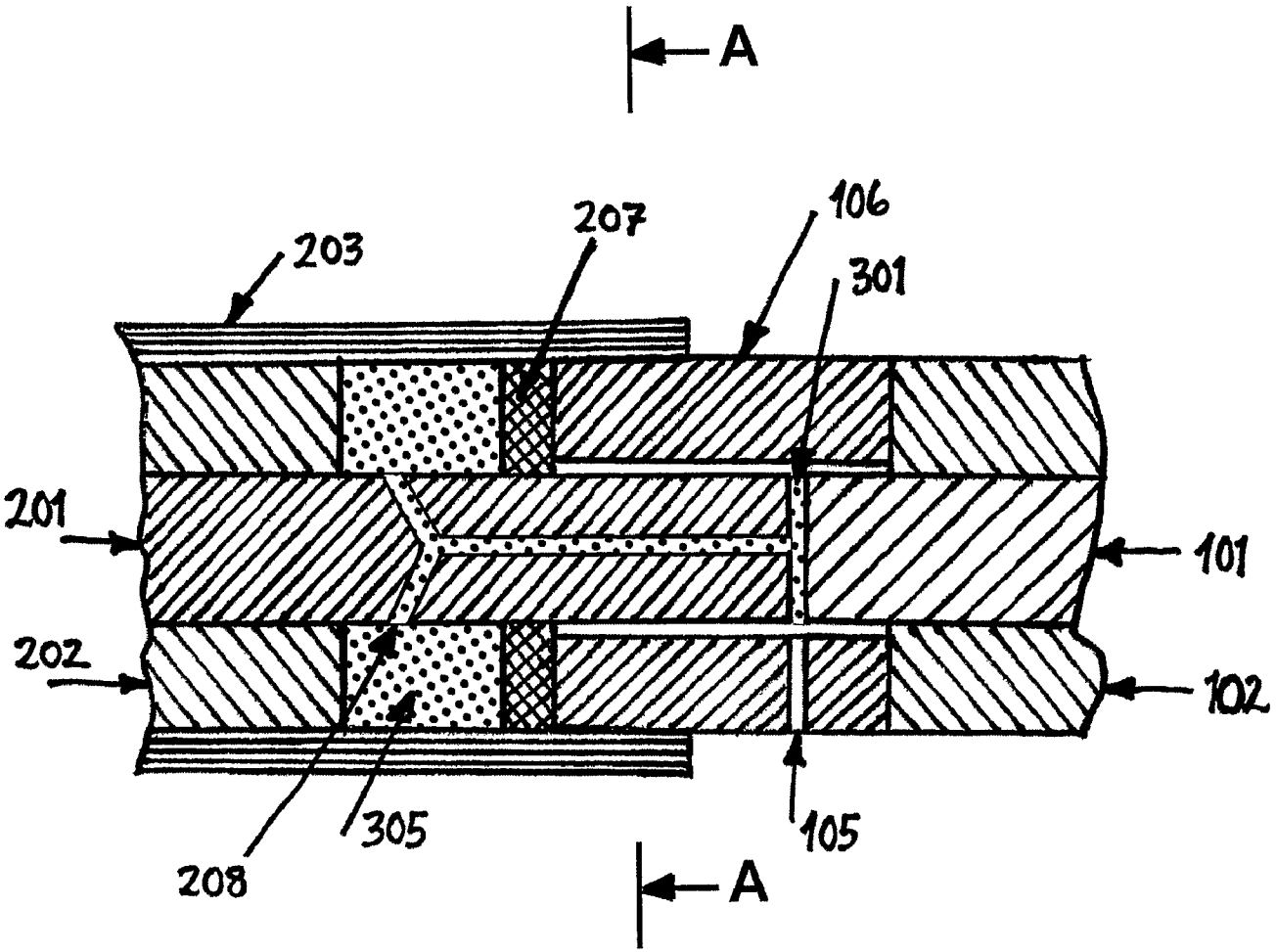
Figure 6:
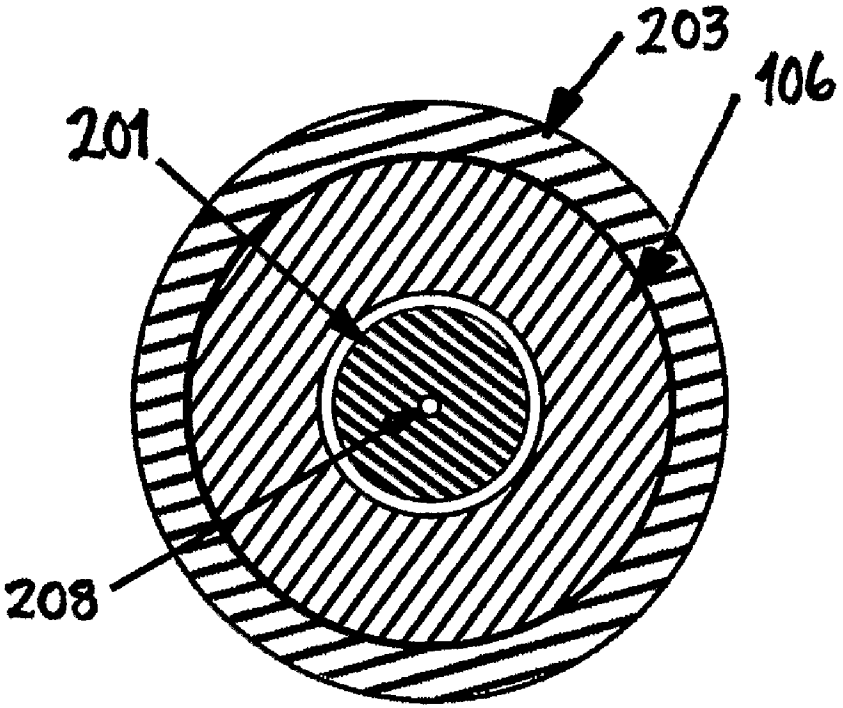

In the following, the present invention will be explained by way of example, and with reference to the accompanying drawings, wherein FIG. 1 is a schematic illustration of a single phase inductive coupler, FIG. 2 is a perspective view illustration of a three phase inductive coupler exemplary embodiment of the invention, FIG. 3*a* is a sectional side view of limbs of an embodiment example of an inductive coupler according to the present invention, with ferrofluid wax in gap, unmated, FIG. 3*b* is a sectional side view of limbs of the embodiment example of an inductive coupler according to the present invention illustrated in FIG. 3*a*, with ferrofluid wax in gap, mated FIG. 4*a* are perspective view illustrations of cylindrical ferrofluid cartridges, one on left side of circular shape, one on right side of square or rectangular shape right, for embodiments of respective inductive couplers according to the present invention, FIG. 4*b* is a sectional side view of limbs of another embodiment example of an inductive coupler according to the present invention, with ferrofluid cartridge, unmated FIG. 4*c* is a sectional side view of limbs of the embodiment example of an inductive coupler according to the present invention, with ferrofluid cartridge, illustrated in FIG. 4*d*, mated FIG. 5*a* is a sectional side view of limbs of yet another embodiment example of an inductive coupler according to the present invention, with ferrofluid reservoir, unmated, FIG. 5*b* is a sectional side view of limbs of the yet another embodiment example of an inductive coupler according to the present invention, with ferrofluid reservoir ("grease cup"), illustrated in FIG. 5*a*, mated, and FIG. 6 is a sectional side view of the embodiment example of an inductive coupler according to the present invention, with ferrofluid reservoir ("grease cup"), illustrated in FIG. 5*a*, mated, taken in a plane indicated by arrows A-A of FIG. 5*b*.

The fat or wax type ferrofluid is preferably adapted to exhibit and maintain its plasticity in the relevant water depth, such as e.g. down to 3000 m below sea level, while not melting to assume a fluidic state, and without otherwise changing its properties, due to e.g. generated heat loss, in a way that it would allow it to escape from the volume to which it is applied to fill. Operating temperature is typically between −5 deg. C. and +40 deg. C.

Commercially available ferrofluids have been made with a viscosity as high as 100.000 mPas (milliPascalsecond), which is about a typical viscosity of very tick honey, and is considered well suited for the application of the present invention identified above.

Patent application U.S. Pat. No. 5,719,546 describes an inductive coupler for which it is placed a plate with high magnetic permeability between the coupling parts of the core, where the plate can be made of an elastic material, resin or gum, containing magnetic particles. In addition to provide an improvement of the magnetic coupling, an essential objective of that prior art is to protect the magnetic core halves against shock induced damage during connection.

An advantage of a ferrofluid is that the magnetic particles of the fluid are allowed to migrate to locations where the magnetic field is strongest, such as in the gap between magnetic halves of the magnetic coupler, and hence improving the magnetic coupling. A magnetic residual flux in the magnetic core would also keep the magnetic particles in this location when the coupler is not energized. This advantage may be employed for use of ferrofluid in form of fat or paste, and also to some degree for use of a ferrofluid in a more solid form, such as in the forms of a plastic wax, a putty or similar, to improve the magnetic coupling.

For obtaining the best performance in applying the present invention, ferrofluid should be used that has very high viscosity and is based on long term stable magnetic particles with excellent magnetic properties, such as e.g. ferromagnetic ceramic particles or magnetic particles based on nano-technology with a saturation level similar to iron for the resulting ferrofluid.

Examples of advantageous embodiments of the inductive coupler of the invention are illustrated in FIG. 3*a* to 5*b*.

With reference to schematic side view of FIG. 1 which illustrates the "C" shaped magnetic halves of a magnetic coupler exhibiting two limbs, and also to the perspective view of FIG. 2 which illustrates the "E" shaped magnetic halves of a magnetic coupler exhibiting three limbs, only one magnetic coupler limb is shown in the sectional views of FIGS. 3*a*, 3*b*, 4*a*, 4*b*, and 5*a*, 5*b*. For efficient transferring of electric power via a magnetic coupler, a coupler in the form of a three phase transformer would exhibit three limbs, while a single phase transformer for sub-sea application normally may be in the form of a shell or pot transformer with the windings on the middle limb, thus exhibiting a centrally located, first limb, and a second limb surrounding the first limb.

The gaps 301 that inevitably is formed between the respective magnetic limbs 101,201 of the two coupler halves, is considered filled with ferrofluid, preferably a ferrofluid in the form of fat or paste or as a plastic wax, putty or similar.

When used in a sub-sea installation, the inductive couplers are preferably made so they are mateable by a remote operated vehicle (ROV), and engaged by torque tool in the normal way, and then locked.

FIG. 3*a* show an arrangement for filling the gap 301 of the inductive coupler with a ferrofluid wax 302 in the form of a plastic wax, putty or similar. This can be achieved by the following.

The ferrofluid in solid form is sufficiently plastic in the relevant water depth, e.g. down to 3000 m below sea level. It is not allowed to melt or flow away from the gap area due to generated heat loss in the magnetic coupler connector.

The ferrofluid wax 302 is preferably provided as a pad or tablet 302, which is positioned located in a collar 205 in one part of the coupler, preferable in a part of the which is not permanently mounted to a sub-sea installation, rather in a part that may be retrieved and brought to the surface.

Reference is now made to FIG. 3*a*. The ferrofluid pad or tablet 302 may, if required, be replaced before each new mating of the connector parts of the magnetic coupler connector of the present invention. For a single phase shell or pot type transformer type magnetic coupler, the gap in the outer, surrounding part of the core could be filled with ferrofluid in solid form as a ring shaped pad, being adapted to fit to the actual cross section of the core limb.

By mating of the coupler halves of a sub-sea located coupler arrangement by a remote operated vehicle (ROV), and engagement securing by use of a torque tool, the pad or tablet 302 will be exposed to pressure from the end surfaces of the limbs 101,201 of the mating parts of the magnetic coupler connector, and, thereby, provide a complete filling of the gap, 301, as illustrated in FIG. 3*b*.

The pad or tablet is preferably provide with a convex shape, to avoid trapping of air or water in the interface between the end surfaces of the limbs 101,201 and the ferrofluid wax pad or tablet during mating of the connector halves. By the collar 205 arranged to surround an exposed coupling end of the magnetic coupler limb, excessive ferrofluid during and after mating of the connector halves will remain located in a cavity between the collar 205 and the coupling ends of the limbs 101 and 201, which will effectively increase the effective core cross section in the coupling area, and, hence, improve the magnetic coupling. Thus, the magnetic properties for the gap area may be made similar to, and possibly even better, better than the magnetic properties of the core limbs.

To isolate parts of the aforementioned cavity that are not being filled by ferrofluid for a deformed ferrofluid pad or tablet by the mating of the connector halves, such parts, inside the connector housing 107,209 are filled with for pressure compensation and corrosion protection by e.g. oil or similar fluid. Such oil or similar fluid could additionally provide better cooling by conduction of heat losses in the electrical windings 102,202 or the magnetic core limbs 101,201 of the magnetic coupler connector during operation. Naturally to avoid having to provide further sealing means to isolate the ferrofluid in the connector from the filling oil, the ferrofluid material of the pad or tablet is stable against the fill oil, and preferably also stable against water that may come into contact with the connector halves before mating.

Reference is now made to FIGS. 4*a*, 4*b* and 4*c* for the following explanation of another advantageous embodiment of the magnetic coupler connector of the present invention. In this embodiment, the ferrofluid 305, illustrated in the drawings by small dots, is held in a ferrofluid cartridge 303. One part of the coupler, preferably a part which is removable and not permanently mounted to other equipment, and in a sub-sea located system retrievable to the surface, provides a space 301 into which the cartridge may be inserted before mating of the connector halves. The space 301 is provided by an outer sleeve 203, preferably an outer sleeve that is located in a coaxial relationship to its respective magnetic coupler core limb 201. The cartridge 303 is pre-filled with a suitable ferrofluid 305, and is provided with end walls 304 with weakenings of the material forming the end walls 304.

With reference to FIG. 4*b*, the halves of the connector shown in a separated state in FIG. 4*a*, have been brought together to a mated stated, in which the exposed ends of the coupling limbs 101,201 have by the weakenings of the end walls 304 penetrated respective end walls 304 on respective sides of the cartridge 303.

The ferrofluid 305 is held in a ferrofluid cartridge 303 in the part of the coupler, which in the case of a sub-sea installation for the connector is the part of the connector that is not permanently mounted, but is a part which can be retrieved to the surface. The cartridge 303, which is pre-filled with ferrofluid 305, and is provided with weakening of material 304, can then be replaced before each mating.

Advantageously, the material of the ferrofluid cartridge 303 itself is a non-magnetic material, such as e.g. a plastic type material, to avoid inducing currents in the cartridge that could possible lead to heating of the cartridge.

During mating of the coupler halves by a remote operated vehicle (ROV) and engagement of the halves by a moment tool, the outer part of the male core 101 is driven through the weakening of material 304 of the side wall of the ferrofluid cartridge, 303. The male connector half winding 102, preferably with reinforcement, will then press the ferrofluid cartridge against the female core 201, which in turn opens the weakening of material 304 in the other end of the ferrofluid cartridge 303, whereby any possible gap 301 is fills with ferrofluid 305 provided by the ferrofluid cartridge.

Any excess ferrofluid 305 driven out of the ferrofluid cartridge during mating of the connector halves is located in the cavity between the cartridge 303 and the cores 101, 201, which will provide an increase the effective core cross section, and hence improve the magnetic coupling Thus, that the magnetic properties for the gap area preferably will be similar to, or possibly even better than, the core itself.

Air or water in the connector halves before mating of the connector parts are vented out through venting holes 206 in enclosure 203 arranged around the limb of the female connector half, as illustrated in FIG. 4*c*, which shows the connector parts in the mated position.

For a magnetic coupler connector according to the invention adapted for a single phase shell or pot type transformer type magnetic coupler, the gap in the outer surrounding part of the core is filled with ferrofluid fat in the same way by a separate ferrofluid annulus or "doughnut" shaped pad.

Other cavities inside the housings 107, 209 of the coupler is provided with suitable means for flushing and filling with an appropriate fluid, such as e.g. an inert oil or similar fluid, for pressure compensation and corrosion protection. The inert fluid would also serve to give better cooling by conduction of heat loss in the magnetic coupler and its windings to the housing parts 107,209 and the surroundings. The ferrofluid 305 is preferably of a type that exhibits good stability with regard the filling fluid of the connector, and preferably also against the water to which it may be subjected before mating and sealing is completed.

The sectional view illustration of FIG. 5*a*, shows an alternative arrangement for filling the gap 301 in the inductive coupler with ferrofluid 305, illustrated in the drawings by small dots. This particular variant of the magnetic coupler of the present invention is adapted to work according to a principle similar to that of a "grease cup".

The ferrofluid 305, which preferably is of a paste type with mechanical properties that resembles those of lubrication grease with respect to deformability and viscosity, is prefilled into a reservoir cavity for ferrofluid 305 of a first half of the connector, which in FIG. 5 is illustrated by the connector half in the left hand part of the drawing. The reservoir cavity for ferrofluid 305 is at one end thereof sealed off by a ring shaped element 207 which when in place in the corresponding connector half is located around the female core 201 and is movable in a piston like way in the reservoir cavity for ferrofluid 305. When considering the sectional view of FIG. 5*a*, the ring shaped element 207 forms a ring shaped piston element that is movable in at least the direction indicated by left pointing arrow, and possibly also in the direction indicated by the right pointing arrow. Preferably, the magnetic coupler connector half adapted for providing the a reservoir cavity 305 with the ring shaped piston element 207 is that part of the coupler which detachable from other associated structures, and which in the case of a sub-sea connector installation is a connector part retrievable to the surface. Filling of the reservoir cavity for ferrofluid 305 in this coupler half with ferrofluid "grease" 305, is advantageously performed in advance of each mating. It is, however, contemplated that the reservoir cavity for ferrofluid 305 is dimensioned to contain a volume of ferrofluid that significantly exceeds the quantity being administered for filling the gap at mating of the connector parts, and preferably a quantity sufficient to perform a plurality of mating operations. To make use of the additional volume, for each new mating operation, an additional ring shaped spacer element is provided adjacent to the ring shaped piston element, the spacer element having a thickness adapted such that it compensates for the movement of the piston ring at each connector mating operation.

The other half of the permanently mounted coupler half, that is the half being illustrated in the right hand part FIG. 5*a*, is fitted with a plunger 106. During mating of the coupler halves, as illustrated in FIG. 5*b*, such as e.g. by way of a remote operated vehicle (ROV) and engagement and securing of halves to each other by way of a torque tool, the plunger will drive the piston ring element 207 inwards, into the reservoir cavity for ferrofluid 305, to force the ferrofluid "grease" 305 to propagate from the reservoir cavity for ferrofluid 305, into and through the ferrofluid canal 208, and into the gap area 301 to fill with ferrofluid any gap between the abutting ends of the magnetic coupler limbs 101 and 201. A vent opening 105 is provided to allow any excess fluid to escape from the interior of the connector. In consideration of the additional spacer suggested above, as an alternative to adding a spacer for each new mating operation, the plunger is contemplated to have a means for accepting an additional plunger extender element for each new mating operation. Thus, a thickness of the extender element would correspond to the thickness of the above alternatively suggested spacer element.

By either the spacer element or the plunger extender element being applied to its respective connector half, at each mating operation, the ring shaped piston element 207 is driven and relocated further into the reservoir cavity for ferrofluid 305, until it reaches a position where it is no longer able to "pump" ferrofluid into the canal 208. At that time, the reservoir cavity needs refilling, which e.g. may suitably be achieved by pumping a supply of new ferrofluid "in reverse" into the canal at the canal opening at the end face of the magnetic coupler limb 101, or by adapting the collar 203, 205 to include a suitably located, closable refilling opening.

Any excessive ferrofluid "grease" 305 more than what is required to fill a gap between the abutting ends of the magnetic coupler limbs 101 and 201, is allowed to propagate into the cavity established between the plunger 106 and the coupler limbs 101,201 at the mating of the connector halves. Such excessive ferrofluid "grease" 305 will in effect increase the effective core cross section and hence improve the magnetic coupling between the limbs 101 and 201, thereby making the magnetic properties for the gap area similar to, or even better than, the core itself.

Any air or water that at mating of the connector halves could be trapped in the connector assembly is vented out through a male part venting hole 105 provided in the plunger 106, as can be seen in FIG. 5*b*, which illustrates the connector halves in the mated position.

FIG. 6 is a sectional side view of the embodiment example of an inductive coupler according to the present invention, with ferrofluid reservoir ("grease cup"), illustrated in FIG. 5*a*, mated, taken in a plane indicated by arrows A-A of FIG. 5*b*. In the view of FIG. 6, which illustrates a section part of one of the limbs of a magnetic coupler connector of the invention having a circular cross section, is seen the sleeve 203, the plunger 106, and annular cavity established between the plunger 106 and core limb 201, the core limb 201, and the canal 208.

Although in FIG. 6 is illustrated a limb and associated elements exhibiting circular cross section shapes, other shapes are contemplated, such as e.g. the square or rectangularly shape shown by the magnetic core limb elements illustrated in the perspective view drawing of FIG. 2.

As for the previously described embodiments, also for this embodiment when a single phase shell or pot type transformer constitutes the magnetic coupler elements of the connector of the invention, the gap in the outer surrounding part of the core is filled with ferrofluid "grease", by provision of additional ferrofluid channels leading from the reservoir to those parts.

Other remaining cavities inside the housings 107 and 209 of the coupler are contemplated can be flushed and filled as described above.

The material in the core, 101 and 201, may be made from ordinary transformer sheet iron, of ferrite, or more sophisticated sintered/ceramic materials, or from so called Metglas which will not corrode and remain stable over long periods of time, also in harsh and corrosive environments like in off-shore, sub-sea installations.

The transformer windings, 102 and 202, can be made in the traditional way as copper windings insulated with varnish or paper in pressure compensated oil or molded in epoxy.

Since an inductive coupler in the principle is a divisible transformer, it can also be made with a transformation ratio for transforming the voltage up or down.

4 kV/400 V can be a relevant transformation ratio for transforming down transmission voltage to sub-sea control system distribution voltage.

Necessary power rating for inductive couplers for electric power to sub-sea control systems will be in the range of 10-100 kW. For the higher power ratings, it may be preferable to use single phase couplers due to the higher high weight and volume for three phase couplers for typical grid frequencies of 50 or 60 Hz.

Such inductive couplers will also function as an isolation transformer, in order to divide the electric system in subsystems between each inductive coupler in series. Each subsystem can then be operated with maximum one earth fault continuously if each subsystem is operated with isolated neutral. This would provide better system availability.

Arrangement for earth fault monitoring is contemplated built into the magnetic coupler connector of the invention, in order to detect a possible earth fault. This can be arranged by including a cable core current transformer in at least one of the coupler halves where this cable core current transformer surrounds the two main phase conductors for an inductive coupler for a single phase circuit, and the three phase conductors for a three phase inductive coupler.

For a three phase circuit with three single phase inductive couplers, either a common outer cable core current transformer surrounding the three phase conductors or an inner cable core current transformer around the main conductor cable in each coupler can be included, and then connect the output from these.

By using cable core current transformers for this earth fault monitoring, galvanic contact with the main power circuit is avoided, which otherwise could have reduced the reliability of the power circuit.

Sub-sea power supply systems are typically be made in the simplest way possible as radial networks, and then it is necessary with only one arrangement for earth fault monitoring for each sub system, i.e. one arrangement for earth fault monitoring in one coupler half for each complete inductive coupler connector assembly.

For three phase inductive couplers, one winding can be delta coupled in order to cancel the third harmonic. Several inductive couplers installed in series in a radial will also reduce the content of over harmonics.

The inductive couplers pertaining to the invention could advantageously also be certified for use in "Ex" installations. This would be useful when testing on-shore, or off-shore on platforms. Use of the inductive coupler connector of the present invention is considered favorable for application in "Ex" installations, on-shore as well as off-shore.

In an advantageous embodiment of the magnetic coupler connector of the present invention particularly well suited for sub-sea applications, a stationary connector half is provided in a so called "stab-in plate" arrangement, thus allowing the first and second connector halves to be mated and maintained in a proper position in relation to each other for operative use by way of the stabilizing properties of the "stab-in" arrangement.

In an advantageous embodiment of the magnetic coupler connector of the present invention, the means for assuring proper mating of the first and second connector halves, and for securing the halves such that a first abutting face of a respective end of a first magnetic coupler limb of a first connector half and a corresponding second abutting face of a respective end of a corresponding second magnetic core limb of said second connector part are maintained in a close coupling relationship to each other also when transferring such levels of energy that could imply high repulsive forces to the limb ends, a force biasing arrangement is contemplated as part of the mating and securing means. Such a force biasing arrangement is contemplated provided by a resilient element being biased by a force applied to the mating and securing means at time of assembling the first and second connector parts for operative use. As an example, the mating and securing means in one embodiment is contemplated realized by a bayonet type closure arrangement typically used for an electrical plug and socket system, wherein a resilient member, such as a metal spring of rubber ring, is provided to establish and transfer by a torque force applied to the turn-to-lock element a linear biasing force to the plug and socket at mating of the parts of the connector system.

REFERENCE NUMERALS OF DRAWING FIGURES

Connector "Male" Half
- 101 Male core
- 102 Male winding
- 103 Male enclosure
- 104 Male cable
- 105 Male venting
- 106 Piston
- 107 Male housing Connector "Female" Half
- 201 Female core
- 202 Female winding
- 203 Female enclosure
- 204 Female cable
- 205 Collar
- 206 Female venting
- 207 Piston ring
- 208 Ferrofluid channel
- 209 Female housing Ferrofluid/Gap
- 301 Gap
- 302 Ferrofluid wax
- 303 Ferrofluid cartridge
- 304 Weakening of material
- 305 Ferrofluid fat

The invention claimed is:

1. A first connector part for an inductive coupler connector for transferring electrical energy between said first connector part to a second connector part, said first and second connector parts having a first magnetic core limb, a respective first electrical winding and a mating means adapted to juxtapose, at mating of said first and second connector parts, a first abutting face of a respective end of said first limb and a corresponding second abutting face of a respective end of a corresponding second magnetic core limb of said second connector part, wherein said first connector part includes a means for providing a ferrofluid filling of a gap between said first and second abutting faces.

2. The first connector part of claim 1, wherein the means for providing a ferrofluid filling of a gap between said first and second abutting faces is a collar device surrounding said respective end of said first limb.

3. The first connector part of claim 2, wherein the collar device is adapted to retain a pad or tablet of ferrofluid adjacently located to said first abutting face of said first limb.

4. The first connector part of claim 2, wherein the collar device is adapted to retain a ferrofluid cartridge located proximal to said first abutting face of said first limb.

5. The first connector part of claim 4, wherein the collar device having the ferrofluid cartridge located therein, which ferrofluid cartridge has first and second end walls exhibiting weakened areas to allow respective ends of said first and second limbs to penetrate respective end walls at mating of said first and second connector parts, provides said ferrofluid to said abutting ends to fill said gap.

6. The first connector part of any one of claims 2 through 5, wherein the collar device has a vent opening for allowing a medium in said collar device to escape at mating of said first connector part with said second connector part.

7. The first connector part of claim 2, wherein the collar device is adapted to receive a ring shaped piston element to establish a ferrofluid reservoir space, and a canal arranged in said first limb to provide a passage for ferrofluid to flow from said reservoir space to said first abutting surface.

8. The first connector part of claim 2, wherein the collar device is adapted to receive a ring shaped piston element to establish a ferrofluid reservoir space between said collar device and said first limb, and a canal arranged in said first limb to provide a passage for ferrofluid to flow from said reservoir space to said first abutting surface.

9. An inductive coupler connector for transferring electrical energy between a first connector part to a second connector part, said first and second connector parts having respective ones of first and second magnetic core limbs of which at least one limb carries a respective electrical winding and respective mating means adapted to provide at a mating of said first and second connector parts at a juxtaposition of abutting faces of respective ends of said respective ones of first and second magnetic core limbs, wherein a gap between the butting faces is filled with ferrofluid in the form of a deformable pad or tablet or a fat, grease or paste containing magnetic particles, in order to improve the magnetic coupling between said ends of said first and second magnetic core limbs.

10. The inductive coupler connector according to claim 9, wherein the ferrofluid is placed in a cavity behind a piston ring before each mating.

11. The inductive coupler connector according to claim 10, wherein with mating of the coupler parts, a piston will move the piston ring inwards and press the ferrofluid fat out through a ferrofluid channel so that the gap is filled with ferrofluid fat, and for a single phase shell or pot type transformer, the gap in the outer surrounding part of the core must be filled with ferrofluid in the same way to separate ferrofluid channels.

12. The inductive coupler connector according to claim 9, wherein the inductive coupler is provided with an arrangement for earth fault monitoring in order to give alarm of a possible earth fault.

13. The inductive coupler connector according to claim 9, wherein a cable core current transformer is included in at least one of the coupler parts where this cable core current transformer surrounds the two main phase conductors for an inductive coupler for a single phase circuit, and the three phase conductors for a three phase inductive coupler, and for a three phase circuit with three single phase inductive couplers, either a common outer cable core current transformer surrounding the three phase conductors can be included, or an inner cable core current transformer around the main conductor cable in each coupler can be included, and then connect the output from these.

14. The inductive coupler connector according to claim 9, wherein remaining cavities in the inductive couplers are filled with e.g. oil or similar for pressure compensation, corrosion protection and cooling by conduction of heat loss.

15. The inductive coupler connector according to claim 9, wherein the gap between the coupler parts is filled with ferrofluid in solid form as a plastic wax, or a similar substance containing magnetic particles in order to improve the magnetic coupling.

16. The inductive coupler connector according to claim 15, wherein the gap between the coupler parts is filled with ferrofluid in the form of pads or tablets, which if necessary can be replaced before each mating and which is located in a collar in a part of the coupler which is not permanently mounted, but can be retrieved to the surface, wherein by engagement of the coupler parts, the pads or tablets will be pressed together so that they fill the gap completely and for a single phase shell or pot type transformer, the gap in the outer surrounding part of the core can be filled with ferrofluid in solid form as a gasket adapted to the relevant core cross section.

17. The inductive coupler connector according to claim 15, wherein the inductive coupler is provided with an arrangement for earth fault monitoring in order to give alarm of a possible earth fault.

18. The inductive coupler connector according to claim 15, wherein a cable core current transformer is included in at least one of the coupler parts where this cable core current transformer surrounds the two main phase conductors for an inductive coupler for a single phase circuit, and the three phase conductors for a three phase inductive coupler and for a three phase circuit with three single phase inductive couplers, either a common outer cable core current transformer surrounding the three phase conductors can be included, or an inner cable core current transformer around the main conductor cable in each coupler can be included, and then connect the output from these.

19. The inductive coupler connector according to claim 15, wherein remaining cavities in the inductive couplers are filled with e.g. oil or similar for pressure compensation, corrosion protection and cooling by conduction of heat loss.

* * * * *

UNITED STATES PATENT AND TRADEMARK OFFICE

CERTIFICATE OF CORRECTION

PATENT NO. : 8,102,230 B2
APPLICATION NO. : 12/682136
DATED : January 24, 2012
INVENTOR(S) : Asbjorn Eriksen It is certified that error appears in the above-identified patent and that said Letters Patent is hereby corrected as shown below:

Claim 9, col. 10, line 40, “the butting faces” should read --the abutting faces--.

Signed and Sealed this
Nineteenth Day of June, 2012

David J. Kappos

David J. Kappos
*Director of the United States Patent and Trademark Office*